United States Patent [19]

Cheng

[11] Patent Number: 4,667,276

[45] Date of Patent: May 19, 1987

[54] LAMP STRING ASSEMBLY WITH PROTECTIVE MEANS

[76] Inventor: Sam Cheng, No. 11, Lane 207, Hsimen St., Hsin-Chu, Taiwan

[21] Appl. No.: 762,113

[22] Filed: Aug. 2, 1985

Related U.S. Application Data

[63] Continuation-in-part of Ser. No. 560,183, Dec. 12, 1983, abandoned.

[51] Int. Cl.[4] ..... F21V 21/00

[52] U.S. Cl. ..... 362/249; 362/806; 362/252; 339/157 C

[58] Field of Search ..... 362/95, 121, 122, 123, 362/151, 152, 226, 227, 235, 236, 237, 242, 248, 249, 252, 267, 376, 377, 378, 437, 443, 806; 340/815.2

[56] References Cited

U.S. PATENT DOCUMENTS

| | | | |
|---|---|---|---|
| 2,719,908 | 10/1955 | Morrison | 362/252 |
| 3,479,636 | 11/1969 | McBride | 339/157 C |
| 3,504,169 | 3/1970 | Freeburger | 362/249 |
| 3,536,906 | 10/1970 | Bloom | 362/249 |
| 3,582,868 | 6/1971 | Trimble | 339/815.2 |
| 3,609,643 | 9/1971 | Connan | 339/815.2 |
| 3,670,160 | 6/1972 | Flowers | 362/249 |
| 3,727,044 | 4/1973 | Monroy | 362/806 |
| 3,968,398 | 7/1976 | Lehmann et al. | 362/95 |
| 4,234,915 | 11/1980 | Malinowski et al. | 362/252 |
| 4,241,387 | 12/1980 | Bowers | 362/252 |

FOREIGN PATENT DOCUMENTS

| | | | |
|---|---|---|---|
| 2115064 | 10/1972 | Fed. Rep. of Germany | 339/157 C |

*Primary Examiner*—E. Rollins Cross

*Attorney, Agent, or Firm*—Bucknam and Archer

[57] ABSTRACT

A lamp string assembly comprises the following elements: plug, insulated lead wire, lamp socket, lamp bulb, lamp shade or shield, an extension socket and a protective means which is provided to cover the lamp socket and to connect with the lamp shade or shield to envelope the wires and to ensure steadiness, water proofing and safety.

12 Claims, 18 Drawing Figures

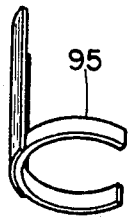
FIG.13
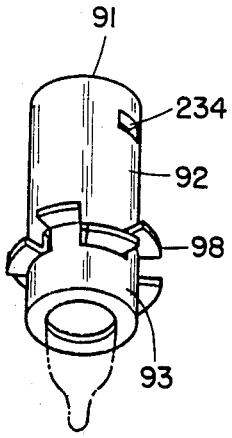
FIG. 11
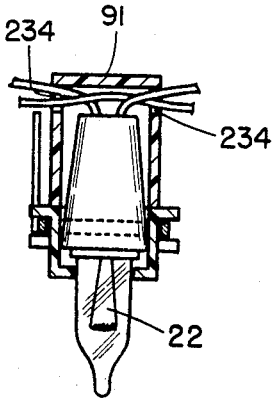
FIG. 12
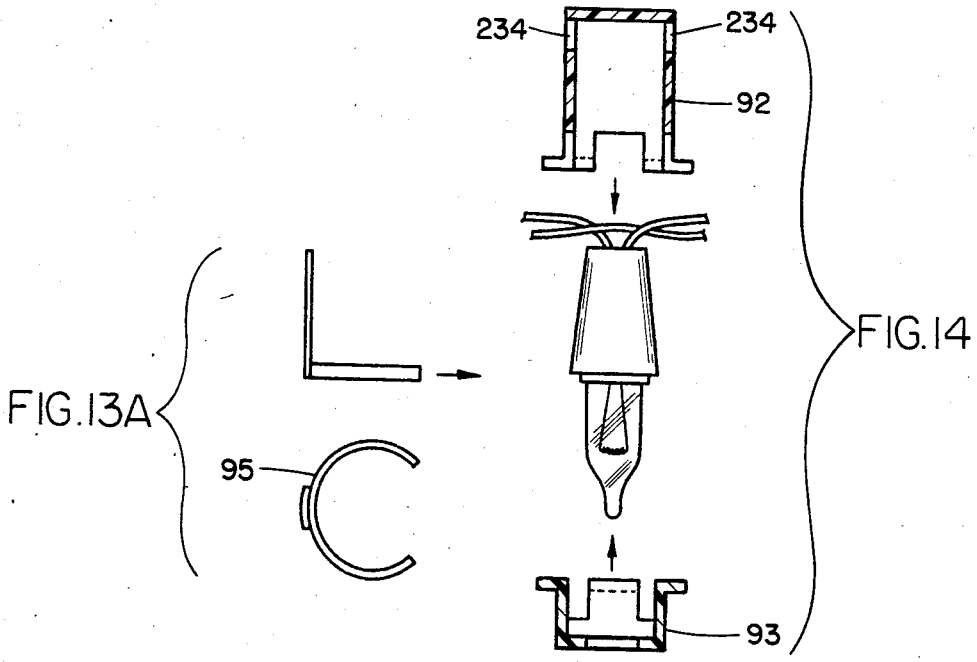

LAMP STRING ASSEMBLY WITH PROTECTIVE MEANS

This application is a continuation-in-part of U.S. Ser. No. 560,183 filed Dec. 12, 1983, now abandoned.

The present invention relates generally to lamp strings such as Christmas decoration lamp strings, and more particularly to a lamp string which comprises in addition to the conventional elements comprising power source plug, insulated lead wire, lamp base, extension socket etc., with electric wire leading out from the lamp base, a protective means which covers the lamp base and connects to the lamp shade or shield to ensure steadiness, water proofing and safety.

In a conventional lamp string, such as a C-7 (candle holder) type or C-9 (sub-medium) type, a plurality of lamp bulbs are respectively connected in parallel to the main lead wire, wherein a pair of conductors are used in the connection, each conductor having one pointed end and a flat or curved end on the other. Each pointed end is to pierce through the insulation of the lead wire and each flat or curved end to contact with respective terminals of the lamp bulb and the outer casing of the lamp base serves as a protective means thereof. Many drawbacks can be seen in such a connecting manner, namely:

(1) piercing through wire insulation would result in short circuit and cause electric shock;

(2) damage to or breaking of wire during piercing would cause a bad connection;

(3) poor contact due to limited contact surface and loose contact cause spark, overheating, even fire;

(4) exposure of wire core due to failure of connection would cause leakage and shock;

(5) decoration effect is limited due to no alternative in bulb selection.

Therefore, the main object of the present invention is to provide a lamp string with perfect protective means, the wires going through them. These means are a hood covering the lamp base and connecting with the lamp shade or shield to ensure steadiness, waterproofing and safety, so that the drawbacks of the prior art are eliminated.

The present invention will become apparent when described in detail in conjunction with the annexed drawings of which:

FIGS. 5–14 and 13A are further embodiments of the protective means of the present invention.

Figure 1:
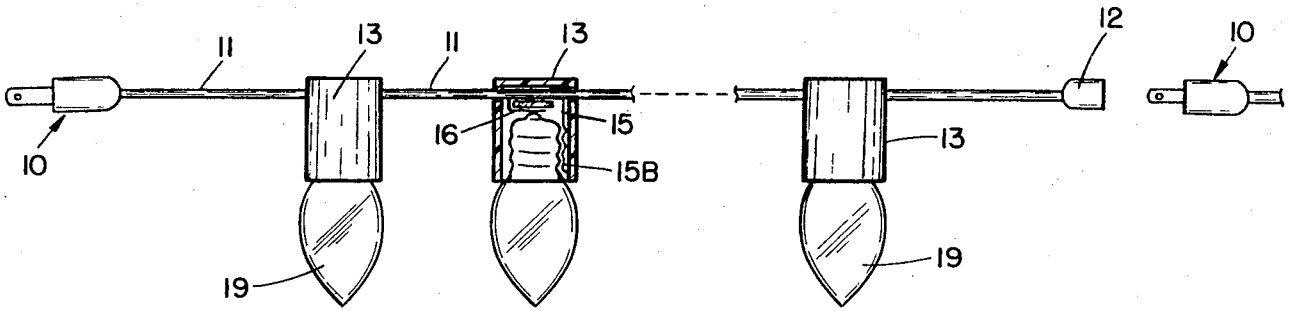
FIGS. 1 and 1A depict the lamp string of the prior art.
Figure 1A:
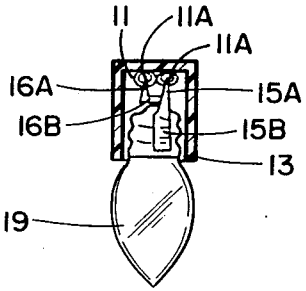
FIG. 1A PRIOR ART

Now referring to FIG. 1, a conventional decorative lamp string comprises a power plug 10 connected to a dual member conduction wire 11. Across the wires, parallel-connected are a plurality of lamps consisting of lamp base 13, lamp bulb 19 and at the other end of the wire 11, a socket 12 is provided for further extension of the string. Within the lamp base 13, a pair of conductors 15, 16 are disposed as two contacts of the bulb 19. Conductors 15, 16 each have a point end 15A (16A) to pierce through the insulation 11A of wire 11, while the other ends 15B, 16B serve as contacts to the terminals of the bulb 19, such as shown in the sectional view FIG. 1A. Such a connection often leads to electrical hazards to endanger the life and property of the consumer.

Figure 2:
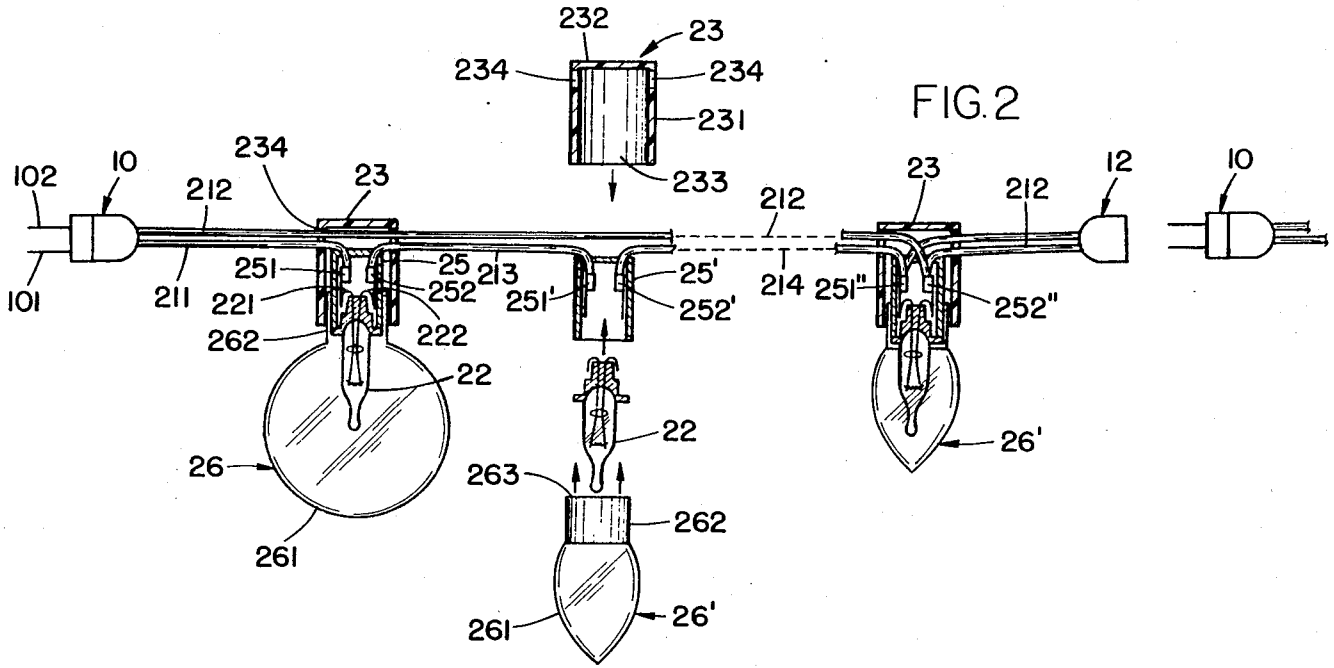
FIGS. 2 and 2A depict schematically a lamp string according to the present invention in which the wiring is an in series electrical connection.

In FIG. 2, the lamp string assembly of the present invention is shown. The assembly comprises a power plug 10, insulating wire 21, lamp socket 25 with conductors 251, 252, bulb 22 and extension socket 12. A protective hood 23 covers the lamp socket to envelop the wires and connections therein to avoid damage. Under the hood 23, a shade 26 or shield 26' is placed to seal the hood in a water-tight manner so that the moisture from the exterior is avoided to facilitate the outdoor use. Besides, since conductors 251, 252 are fixedly attached to wire members 211, 213 instead of the pierce-through practice in the conventional practice, leakage due to bad connection is totally avoided.

FIG. 2 shows an embodiment by way of a three lamp socket assembly, which comprises:

A power source plug 10 which has at least two male terminals 101, 102 for insertion into a source of power.

First and second insulated wires 211, 212 which extend from the power source plug 10.

Each lamp socket 25 of at least three lamp sockets is adapted to receive a lamp 22 inserted therein, each lamp socket including first and second terminals 251, 252 positioned within the lamp socket for making contact with first and second lamp terminals respectively of a lamp inserted into the lamp socket.

The first insulated wire 211 extends from the power source plug to the first terminal 251 of the first lamp socket of the at least three lamp sockets and electrically coupled to the first terminal 251.

A third insulated wire 213 is electrically coupled to the second terminal 252 of the first lamp socket 25 and extends to and is electrically coupled to the first terminal 251' of the next lamp socket 25' of the at least three lamp sockets.

A fourth insulated wire 214 is electrically coupled to the second terminal 252' of the next lamp socket 25' and extends to and is electrically coupled to the first terminal 251' of the last lamp socket 25'' of the at least three lamp sockets.

The second insulated wire 212 extends from said power source plug 10 to the second terminal 252'' of the last lamp socket 25'' and is electrically coupled to the second terminal 252'' for completing a series electrical connection between the power source plug 10 and the at least three lamp sockets 25, 25', 25''.

It may be looked in another way that an extension socket 12 receives at least two insulated wires 212, 214 from the power source plug 10, and the first insulated wire 211 extends from the first terminal 251 of the first lamp socket 25 to the extension socket 12 and the second insulated wire 212 extends from the second terminal 252'' of the last lamp socket 25'' to the extension socket 12 for extending the power applied through the power source plug 10 to the extension socket 12.

The shade means defining a cavity comprises a crown 261, a neck 262 and an opening 263 at the end of the neck 262 for inserting over the lamp socket 25 for covering that portion of said lamp socket adapted to receive a lamp.

The hood means 23 defining a cavity have cylindrical walls 231 and a base 232 and an opening 233 opposite the base and the hood is adapted for inserting over the lamp socket 25 and over the neck 262 of the shade means 26 for securing the lamp socket 25 from moisture.

The wiring of the string may be effected in a series electrical connection such as shown in FIG. 2 wherein:

A power source plug has at least two male terminals 101, 102 and first and second insulated wires 211, 212 are individually coupled to the plug 10 for conducting electrical power applied through the plug.

Each lamp socket 25 of the plurality of lamp sockets is adanted to receive an electric lamp 22, and the socket 25 includes first and second terminals 251, 252 for making electric connection with the power supply and the terminals 221, 222 of the lamp bulb 22 which the lamp socket 25 is adapted to receive.

The first wire 211 extends from the plug 10 to the first terminal 251 of the first lamp socket 25.

Third insulated wire 213 serially connects the second terminal of the first lamp socket 25 to the first terminal 251' of the subsequent lamp socket 25' and continues in electric series connection from the second terminal 252' of the subsequent lamp socket 25' to the first terminal 251'' of the last lamp socket 25''.

The second insulated wire 212 extends from the plug 10 to the second terminal 252'' of the last lamp socket 25'' for completing the electric series connection from said plug 10.

The shade means 26, 26' defining a hollow cavity include a crown 261 at one end and opening 263 in the crown with a neck portion 262 between the crown and the opening. The opening 263 and the neck portion 262 are adapted to receive and cover a portion of a lamp socket 25 in which an electric lamp bulb 22 is inserted.

Hood means 23 defines a cavity having walls 231 and a base 232 and an opening 233 in the wall opposite said base, and the opening and the walls are adapted to be inserted over that portion of the lamp socket 25 extending out of the shade means 26, 27 and over a portion of the shade means inserted over the lamp socket 25 for securing the lamp socket 25 and the electric lamp bulp 22 from moisture. The hood means 23 also include first and second ports 234 in the wall 231 adjacent the base 232, for providing an entrance and an exit for insulated wires forming the electric series circuit.

Figure 2A:
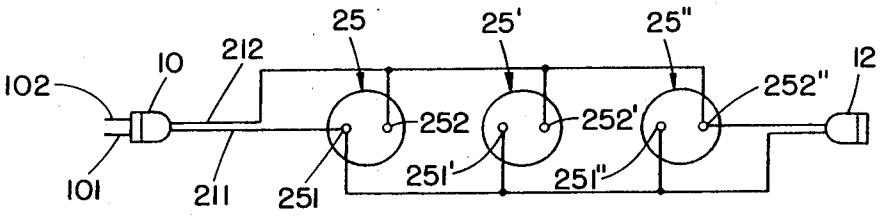

The wiring of the string may also be effected in a parallel electrical connection such as shown in FIG. 2A, wherein extension socket means receive at least two insulated wires for receiving power applied through the power source plug 10.

Figure 3A:
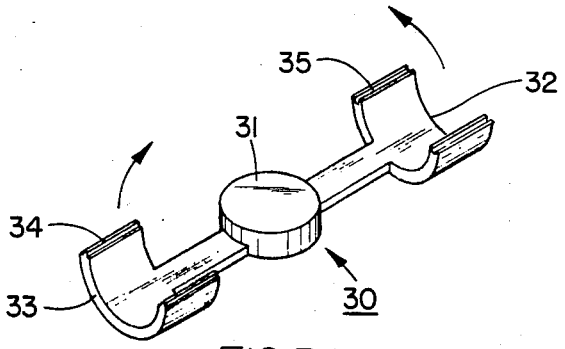
FIGS. 3A and 3B are an extended and a folded-up view respectively of an embodiment of the protective means according to the present invention, illustrated in perspective.
Figure 3B:
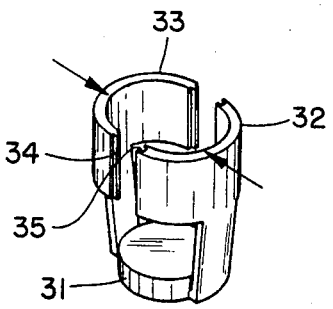

The first insulated wire 211 extends from the first terminal 251 of the first lamp socket 25 to the extension socket means 12 and is coupled thereto. The second insulated wire 212 extends from the second terminal 252'' of the last lamp socket 25'' to the extension socket means 12 and is coupled thereto whereby the serially connected decorative lamp string is connected in parallel electric connection with respect to the circuit formed between the power source plug 10 and the extension socket means 12. FIG. 3 shows an embodiment of the protective hood 30, wherein a center circular top piece 31 and a pair of curved wings 32 and 33 are molded integrally (FIG. 3A), wings 32 and 33 are foldable along the direction of the arrows to form a circular grip (FIG. 3B) to be fitted around the lamp socket. The two curved semi-circular wings 32, 33 are provided with tenson 34 and mortise 35 on their respective side walls to serve as joint means.

Figure 4:
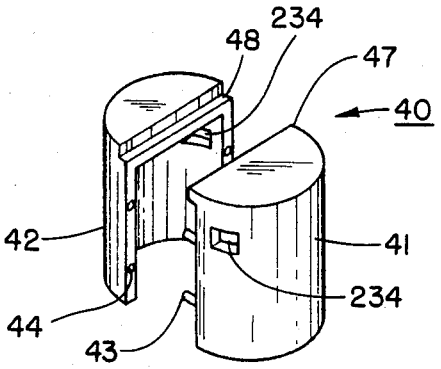
FIG. 4 is a perspective view of another embodiment of the protective means of the present invention.

FIG. 4 shows another embodiment of the protective hood 40 wherein two separate semi-circular pieces 41, 42 having on their top, recess and tongue grooves 47–48 for matching, on respective side walls, pins 43 and holes 44 serve as joint means when the two halves grip on the lamp socket with shade or shield. Openings 234 are for the passing through of the wires.

Figure 5:
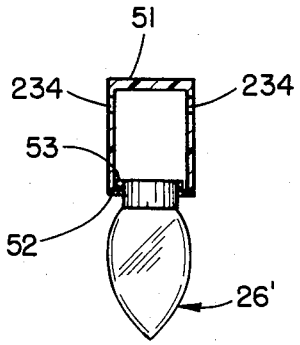

In FIG. 5, the inset flange 52 of a protective hood 51 is matched with the out-extended flange 53 of a shield 27 to form a seal.

Figure 6:
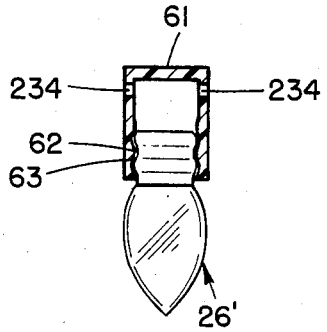

In FIG. 6, a screw joint connection is made by providing the hood 61 with female threads 62 and the shield 27 with male threads 63.

Figure 7:
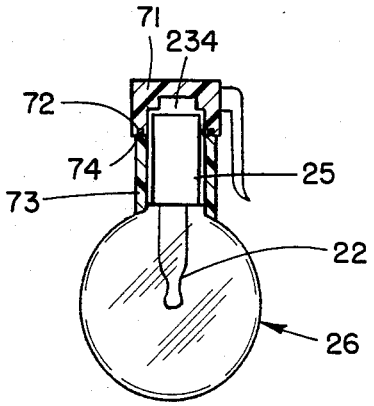
Figure 8:
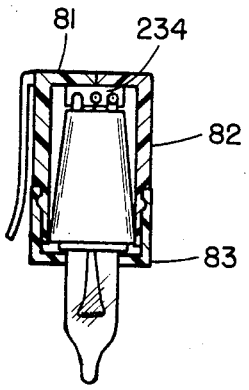
Figure 9:
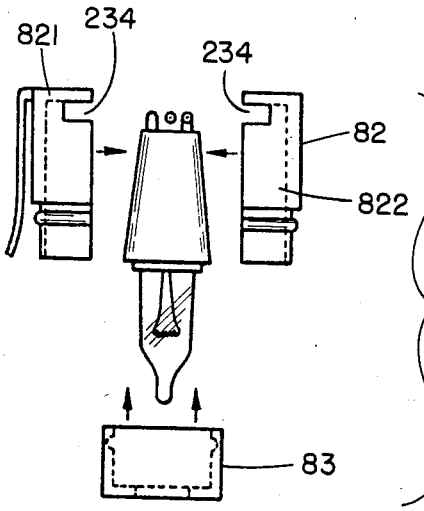
Figure 10:
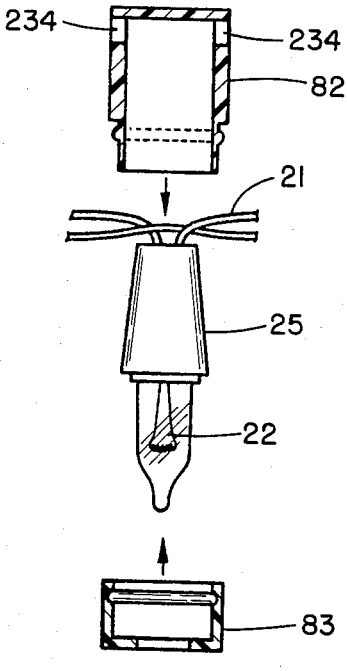

In FIG. 7, the hood 71 is provided with a circular groove 72 thereunder to match up with the circular tongue 74 on the extension portion 73 of the lamp shade 26. Openings 234 for the passing through of the wires are provided FIGS. 8–14 illustrate other embodiments of the invention. In FIG. 8, the hood 81 consists of an upper part 82 and a bottom part 83 which engage with each other with tongues fitting into grooves. The top part is made up of one left and one right structure 821, 822 in FIG. 9.

In the embodiment of FIGS. 11–14, the hood 91 consists of two parts, the upper part 92 and the bottom part 93. The two parts have flanges 98 positioned at the lower edge of the top part and at the top edge of the bottom part respectively, which flanges interlock in the recesses between the flanges as shown in FIG. 11. FIG. 12 shows the assembled hood and lamp base.

FIG. 13 is an elevational view of the clamp ring 95 used to hold the two parts 92 and 93 tightly sealed. FIG. 13A is a top view of the clamp ring. FIG. 14 is an exploded view of the lamp socket and the two parts of the hood 92 and 93. The clamp ring 95 presses down on the top part 92 and presses up on the bottom part 93.

To summarize, the present invention eliminates all the drawbacks mentioned above and provides a safeguard lamp strings with proper electrical contacts and connections to avoid leakage, short circuit, shock and related hazards so that the product can fully meet the outdoor purpose as a result of the tight seal of the protective hood with the shade or shields. In all the embodiments, openings are provided on the hood to let through the insulation wire for the lamp base and all the joints, no matter what type they are, may be sealed up with adhesives or high frequency fusion to ensure tightness.

What is claimed is:

1. A decorative lamp string assembly having at least three lamp sockets said assembly comprising;

a power source plug having at least two male terminals for insertion into a source of power, first and second insulated wires extending from said power source plug, each lamp socket of said at least three lamp sockets adapted to receive a lamp inserted therein, each said lamp socket including first and second terminals positioned within said lamp socket for making contact with first and second lamp terminals respectively of a lamp inserted into said lamp socket, said first insulated wire extending from said power source plug to said first terminal of the first lamp socket of said at least three lamp sockets and electrically coupled to said first terminal, a third insulated wire electrically coupled to said second terminal of said first lamp socket and extending to and electrically coupled to the first terminal of the next lamp socket of said at least three lamp sockets, a fourth insulated wire electrically coupled to said second terminal of said next lamp socket and extending to and electrically coupled to said first terminal of the last lamp socket of said at least three lamp sockets, said second insulated wire extending from said power source plug to said second terminal of said last lamp socket and electrically coupled to said second terminal for completing a series electrical connection between said power source plug and said at least three lamp sockets, shade means defining a cavity having a crown, a neck and an opening at the end of said neck for inserting over said lamp socket for covering that portion of said lamp socket adapted to receive a lamp and hood means defining a cavity having cylindrical walls and a base and an opening opposite said base, said hood adapted for inserting over said lamp socket and over said neck of said shade means for securing said lamp socket from moisture.

2. A decorative lamp string assembly as in claim 1 and further including, an extension socket for receiving at least two insulated wires from said power source plug, said first insulated sire extending from said first terminal of said first lamp socket to said extension socket, and said second insulated wire extending from said second terminal of said last lamp socket to said extension socket for extending the power applied through said power source plug to said extension socket.

3. A decorative lamp string assembly as in claim 1 and in which the neck portion of said shade means has helical grooves about the periphery thereof and the wall portion of said hood means has helical grooves about the interior thereof for mating with said grooves about said neck position and said hood means is screw connected to said shade means for securing said lamp socket.

4. A decorative lamp string of a plurality of lamp sockets connected in series electric connection comprising;

a power source plug having at least two male terminals, first and second insulated wires individually coupled to said plug for conducting electric power applied through said plug, each lamp socket of said plurality of lamp sockets adapted to receive an electric lamp, said socket including first and second terminals for making electric connection with the power supply and the terminals of the lamp which the lamp socket is adapted to receive, said first wire extending from said plug to said first terminal of the first lamp socket of said plurality, third insulated wire serially connecting said second terminal of said first lamp socket to said first terminal of the subsequent lamp socket in said plurality and continuing in electric series connection from said second terminal of said subsequent lamp socket to said first terminal of the last lamp socket of said plurality, said second insulated wire extending from said plug to said second terminal of said last lamp socket for completing said electric series connection from said plug, shade means defining a hollow cavity including a crown at one end and opening in said crown with a neck portion between said crown and said opening, said opening and said neck portion adapt to receive and cover a portion of a lamp socket in which an electric lamp is inserted, and, hood means defining a cavity having walls and a base and an opening in said wall opposite said base, said opening and said walls adapted to be inserted over that portion of said lamp socket extending out of said shade means and over a portion of said shade means inserted over said lamp socket for securing said lamp socket and said electric lamp from moisture, and said hood means also including first and second ports in said wall, adjacent said base, for providing an entrance and an exit for insulated wires forming the electric series circuit.

5. A decorative lamp string as in claim 4 and in which said wall of said hood means and said neck of said shade means are screw and thread connected.

6. A decorative lamp string as in claim 4 and in which the wall of said hood means extending from said base is formed by at least two semi-cylindrical sections.

7. A decorative lamp string as in claim 4 and in which the wall of said hood means extending from said base is formed by at least two semi-cylindrical elements and the elements are jointed by tenon and mortise means.

8. A decorative lamp string as in claim 4 and in which the wall of said hood means extending from said base is formed by at least two semi-cylindrical elements and the elements are jointed by a tongue and mating recess and including a plurality of pins and mating holes for aligning said two semi-cylindrical elements.

9. A decorative lamp string as in claim 4 and further including, extension socket means for receiving at least two insulated wires for receiving power applied through said power source plug, said first insulated wire extended from said first terminal of said first lamp socket to said extension socket means and coupled thereto, and said second insulated wire extended from said second terminal of said last lamp socket to said extension socket means and coupled thereto whereby the serially connected decorative lamp string is connected in parallel electric connection with respect to the circuit formed between said power source plug and said extension socket means.

10. The decorative lamp string according to claim 4 wherein said hood means comprises an upper part and a lower part, the upper part being made of one left and one right structure, said upper part and said lower part having tongues and recesses, the tongues of the upper part engaging in the recesses in the lower part.

11. The decorative lamp string according to claim 4 wherein said hood means comprises an upper part and a lower part, the upper part having a plurality of flanges at the lower edge thereof, the lower part having a plurality of flanges at the top edge thereof, said flanges of the top part engaging in the recesses between the flanges of the bottom part.

12. The decorative lamp string according to claim 11 which comprises a clamp ring to hold said upper and bottom part in sealing engagement.

* * * * *